US009166272B2

(12) United States Patent
Liu et al.

(10) Patent No.: US 9,166,272 B2
(45) Date of Patent: Oct. 20, 2015

(54) ARTIFICIAL MICROSTRUCTURE AND METAMATERIAL USING THE SAME

(75) Inventors: Ruopeng Liu, Shenzhen (CN); Lin Luan, Shenzhen (CN); Chaofeng Kou, Shenzhen (CN); Fanglong He, Shenzhen (CN)

(73) Assignees: KUANG-CHI INNOVATIVE TECHNOLOGY LTD., Shenzhen (CN); KUANG-CHI INSTITUTE OF ADVANCED TECHNOLOGY, Shenzhen (CN)

( * ) Notice: Subject to any disclaimer, the term of this patent is extended or adjusted under 35 U.S.C. 154(b) by 113 days.

(21) Appl. No.: 13/634,506

(22) PCT Filed: Oct. 27, 2011

(86) PCT No.: PCT/CN2011/081413

§ 371 (c)(1),
(2), (4) Date: Sep. 12, 2012

(87) PCT Pub. No.: WO2012/159418

PCT Pub. Date: Nov. 29, 2012

(65) Prior Publication Data

US 2013/0154901 A1 Jun. 20, 2013

(51) Int. Cl.
*H01Q 1/00* (2006.01)
*H01Q 15/00* (2006.01)

(52) U.S. Cl.
CPC ..... *H01Q 1/00* (2013.01); *H01Q 15/0086* (2013.01)

(58) Field of Classification Search
USPC ..... 343/907, 895, 742, 767, 873
See application file for complete search history.

(56) References Cited

U.S. PATENT DOCUMENTS 4,369,557 A * 1/1983 Vandebult ..... 29/25.42
4,792,790 A * 12/1988 Reeb ..... 340/572.5
5,495,250 A * 2/1996 Ghaem et al. ..... 342/51

(Continued)

FOREIGN PATENT DOCUMENTS

CN 101431171 A 5/2009
CN 101826657 A 9/2010
CN 101971493 A 2/2011

OTHER PUBLICATIONS

"A 3-D Isotropic Left-Handed Metamaterial Based on the Rotated Transmission-Line Matrix (TLM) Scheme", by Michael Zenler et al. <<IEEE Transactions on Microwave Theory and Techniques>>, IEEE Service Center, Piscataway, NJ, US, vol. 55, No. 12, Dec. 2007, pp. 2930-2941, XP011197536, ISSN: 0018-9480, DOI: 10.1109/TMTT.2007.909608, abstract, and Figs. 4-6 and 13b.

(Continued)

*Primary Examiner* — Huedung Mancuso
(74) *Attorney, Agent, or Firm* — Leason Ellis LLP.

(57) ABSTRACT

The present invention provides an artificial microstructure including a first metal wire, a second metal wire parallel to the first metal wire, at least one first metal wire branch and at least one second metal wire branch. The at least one first metal wire branch and the at least one second metal wire branch are distributed in an interlacement arrangement. One end of the at least one first metal wire branch is connected to the first metal wire; the other end is a free end facing towards the second metal wire. One end of the at least one second metal wire branch is connected to the second metal wire, and the other end of the at least one second metal wire is a free end facing towards the first metal wire. The present invention also discloses a metamaterial with the artificial microstructures.

19 Claims, 7 Drawing Sheets

(56) References Cited

U.S. PATENT DOCUMENTS

| | | | | |
|---|---|---|---|---|
| 7,434,739 | B2 * | 10/2008 | Matsuura et al. | 235/492 |
| 7,501,954 | B1 * | 3/2009 | Chung | 340/572.7 |
| 8,674,891 | B2 * | 3/2014 | Lopez et al. | 343/753 |
| 2005/0225492 | A1 | 10/2005 | Metz | |
| 2010/0053019 | A1 | 3/2010 | Ikawa et al. | |
| 2010/0079217 | A1 | 4/2010 | Morton et al. | |
| 2010/0314040 | A1 | 12/2010 | Tyler, II et al. | |

OTHER PUBLICATIONS

"A two-dimensional uniplanar transmission-line metamaterial with a negative index of refraction", by Francis Elek and George V Eleftheriades, <<New Journal of Physics>>, Institute of Physics Publishing, Bristol, GB, vol. 7, No. 1, Published on Aug. 8, 2005; pp. 163-163,XP020092886, ISSN: 1367-2630, DOI: 10.1088/1367-2630/7/1/163; Abstract and Fig. 5.

* cited by examiner

ARTIFICIAL MICROSTRUCTURE AND METAMATERIAL USING THE SAME

CROSS-REFERENCE TO RELATED PATENT APPLICATIONS

This is a U.S. National Phase Application under 35 U.S.C. §371 of International Patent Application No. PCT/CN2011/081413, filed Oct. 27, 2011, and claims the priority of Chinese Patent Application No. CN 201110131783.3 filed May 20, 2011, all of which are incorporated by reference herein.

FIELD OF THE INVENTION

The present invention relates to materials, and particularly, to an artificial microstructure and a metamaterial using the same.

BACKGROUND OF THE INVENTION

Permittivity is a parameter of a material responding to the electric field. The material can generate induced charges under the action of external electric field, but resulting in weakening the electric field. The ratio of the external electric field of original vacuum to the electric field of the final material is called permittivity. Any kind of material has its specific permittivity value or permittivity curve in the natural world. When the material with high permittivity is placed in the electric field, the strength of the electric field will produce a considerable decrease in dielectric material. The material with high permittivity, such as dielectric insulator, is often used to produce capacitors. The electromagnetic wave has a very short wavelength in dielectric material with high permittivity, which can greatly reduce the size of the radio frequency and microwave devices.

With the rapid development of science and technology, people constantly set higher and higher standards for material application. In some cases, the needed permittivity value of the material is much greater than that of the existing material in the nature world. The existing dielectric with high permittivity can not meet the standards, which will become the bottleneck in the development of technology and related product research. Thus, artificial metamaterials are applied to achieve these purposes and solve these problems.

Metamaterial is new artificial composite structure material with extraordinary physical characteristic which does not exist in the natural materials. By placing the microstructures in ordered arrangement, the relative permittivity and the permeability of each point are changed in space. The metamaterial has the permittivity and the permeability that the common materials do not exist within a certain range to effectively control the propagation characteristics of electromagnetic waves.

The metamaterial includes a substrate and a plurality of artificial microstructures attached to the substrate. The artificial microstructures are composed of metal wires and have a certain geometrical shape formed by the metal wires. The artificial microstructures are placed on the substrate in an array arrangement. The substrate is a structure that serves to support the arranged artificial microstructures. The substrate can be made of any materials different from that of the artificial microstructures. The two different types of materials of the substrate and the artificial microstructures are overlapped together to produce an equivalent permittivity and permeability in space, and the two physical parameters respectively correspond to the electric field response and magnetic field response of the entire material. The electromagnetic response of the metamaterial is dependent on the characteristics of the artificial microstructures, and the electromagnetic responses of the artificial microstructures are mostly dependent on the topological characteristics of the metal wires and the size of metamaterial units. The size of each metamaterial unit is depended on the needed electromagnetic waves responded by the artificial microstructures. The size of each artificial microstructure is usually about one tenth of the wavelength of the electromagnetic waves that need to respond, otherwise the arrangement formed by the artificial microstructures cannot be considered to be continuous.

Referring to FIG. 1, in the typical production process of metamaterial, "I" shaped artificial microstructures are usually applied to change the distribution of the permittivity in space. The metamaterial can be formed by the array arrangement of substrate units attached by artificial microstructures. The size range of each substrate unit is from one tenth to one fifth of the wavelength of the electromagnetic waves. In a limited space, the change range of the size of the "I" shaped artificial microstructure is limited, and accordingly the changeable range of the permittivity of the metamaterial unit is limited too.

DISCLOSURE OF THE INVENTION

Aiming at the defects of the existing technology, the technical problem to be solved in present invention is to provide a microstructure with high permittivity.

The present invention provides an artificial microstructure which includes a first metal wire, a second metal wire parallel to the first metal wire, at least one first metal wire branch and at least one second metal wire branch; the at least one first metal wire branch and the at least one second metal wire branch are distributed in an interlacement arrangement, one end of the at least one first metal wire branch is connected to the first metal wire, the other end is defined as a free end facing towards the second metal wire. One end of the at least one second metal wire branch is connected to the second metal wire, and the other end of the at least one second metal wire as a free end faces towards the first metal wire.

The at least one first metal wire branch and the at least one second metal wire branch are evenly distributed.

The at least one first metal wire branch and the at least one second metal wire branch are parallel to each other.

The at least one first metal wire branch is perpendicular to the first metal wire, and the at least one second metal wire branch is perpendicular to the second metal wire.

The number of the at least one first metal wire branches is equal to the number of the at least one second metal wire branches.

The number of the at least one first metal wire branches is unequal to the number of the at least one second metal wire branches.

The present invention further provides a metamaterial including at least one metamaterial layer. Each metamaterial layer includes a substrate and at least one above described artificial microstructure, wherein the at least one artificial microstructure is attached to the substrate.

Each metamaterial layer includes at least two artificial microstructures.

The metamaterial further includes at least three third metal wires, and the at least three third metal wires are connected to the first metal wire and/or the second metal wire.

The third metal wires are connected between the first metal wire and the second metal wire of the two adjacent artificial microstructures.

Each third metal wire is a straight line.

Each third metal wire is a curve.

Each third metal wire is a sinuous curve.

The plurality of artificial microstructures are placed on the substrate in an array arrangement.

The substrate is divided into a plurality of identical cuboid metamaterial units in the form of array arrangement, and each substrate unit is attached by an artificial microstructure.

A side of the substrate falls within a range from one tenth to one fifth.

The substrate is made from any of FR-4, F4b, CEM1 and TP-1.

The substrate is made from any of polytetrafluoroethylene, ferroelectric material, ferrite material and ferromagnetic material.

The metamaterial includes a plurality of substrates stacked together, and each substrate is attached by a plurality of artificial microstructures.

Any two adjacent substrates are connected together by filling with liquid substrate materials.

Using the present disclosure of metamaterial, by changing the shape of the existing artificial microstructures, the first metal wire branches and the second metal wire branches are constructed in each artificial microstructure and are placed in an interlacement distribution, thus enlarging the area of the metal wires, increasing the capacitance of the artificial microstructures and further increasing the permittivity and refractive index of the metamaterial. Simulation results show that the permittivity of the metamaterial using the artificial microstrucutres is very steady. Compared with the "I" shaped artificial microstructures, the refractive index and the permittivity of the metamaterial greatly increased. The metamaterial with high permittivity can be applied to the field of antenna manufacture and semiconductor manufacturing. The technical solution breaks through the defects of the existing technology that the permittivity is limited in unit volume, and has an invaluable role for the miniaturization of the microwave devices.

Other advantages and novel features of the present disclosure will become more apparent from the following detailed description of preferred embodiment when taken in conjunction with the accompanying drawings.

DETAILED DESCRIPTION OF ILLUSTRATED EMBODIMENTS

To improve the electromagnetic characteristics of the typical electromagnetic material in the existing technology, the present invention provides a metamaterial, and compared with the existing materials and known metamaterial, has the advantages of improving permittivity and reflective index of the metamaterial.

Figure 1:
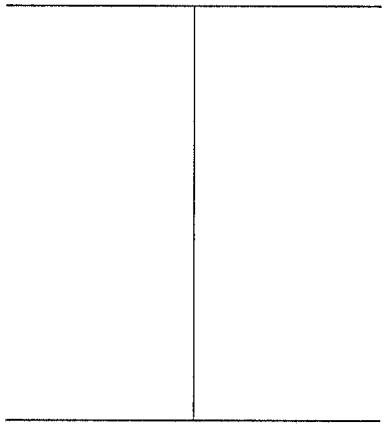
FIG. 1 is a schematic view of an existing embodiment of a typical "I" shaped artificial microstructure.
Figure 2:
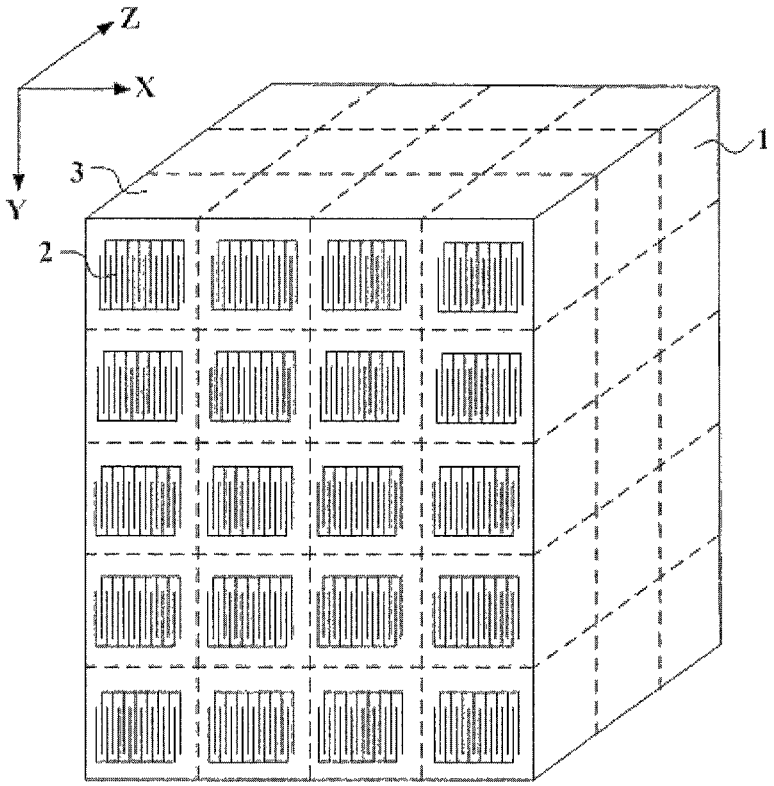
FIG. 2 is a structural schematic view of a metamaterial according to a first embodiment.
Figure 3:
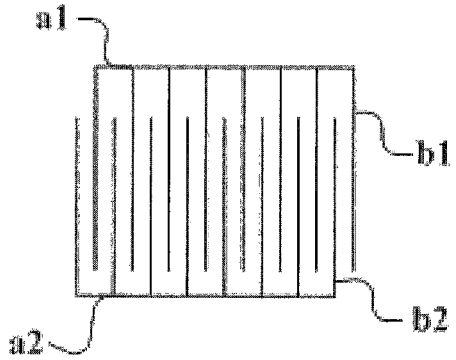
FIG. 3 is a structural schematic view of one artificial microstructure shown in the first embodiment of this disclosure.

Referring to FIGS. 2 and 3, the present disclosure provides a new type of metamaterial, and compared with the existing metamaterial, the permittivity of the metamaterial is improved by changing the topology structure of the artificial microstructures in the metamaterial. Referring to FIG. 2, the metamaterial includes three metamaterial layers 1, and the three metamaterial layers 1 are stacked together in turn along a direction perpendicular to the plane of the substrate (the direction of Z axis). The three metamaterial layers 1 can be connected together by filling with such as liquid substrate materials therebetween, so that when the liquid substrate materials are solidified, any two adjacent metamaterial layers 1 are fixed together to form an integral whole. Each of the metamaterial layers 1 includes a substrate and a plurality of artificial microstructures attached to the substrate. The substrate can be made from FR-4, F4b, CEM1, TP-1 or other ceramic materials with high permittivity, and can also be made from polymer materials such as polytetrafluoroethylene, ferroelectric material, ferrite material or ferromagnetic material. The artificial microstructures can be attached to the substrate by means of etching, plating, drilling, photolithography, electronic engraving or ion etching.

Each metamaterial layer 1 is virtually divided into a plurality of identical cuboid metamaterial units 3, the metamaterial units 3 are close adjacent to each other and are arranged along the X-direction for the row, the Y-direction for the column orthogonal to the X-direction. Each metamaterial unit 3 includes a substrate unit and a plurality of artificial microstructures 2 attached to the substrate unit. In one embodiment, a side (e.g., a width, a length or thickness) of the metamaterial unit 3 falls within a range, the range being less than one fifth of a wavelength of the incident electromagnetic wave, preferably one tenth to one fifth. Referring to FIG. 3, the metamaterial of the present disclosure is made up of a plurality of the identical metamaterial units 3 with the same length, width and thickness respectively, which are arranged along the X-direction, Y-direction, and the Z-direction into the array. In other embodiment, the thickness (the length along the Z-direction) of the metamaterial unit 3 is not necessary equal to the length and width, so long as that is not greater than the length and width.

Referring to FIG. 3, each artificial microstructure includes a first metal wire a1, a second metal wire a2 parallel to the first metal wire a1, eight first metal wire branches b1 and eight second metal wire branches b2. One end of each first metal wire branch b1 is connected to the first metal wire a1, the other end is defined as a free end facing towards the second metal wire a2. One end of any second metal wire branch b2 is connected to the second metal wire a2, and the other end as a free end faces towards the first metal wire a1. The first metal wire branches b1 and the second metal wire branches b2 are parallel to each other and are evenly interlacement distributed. The first metal wire branches b1 and the second metal wire branches b2 are perpendicular to the first metal wire a1 and the second metal wire a2.

Figure 4:
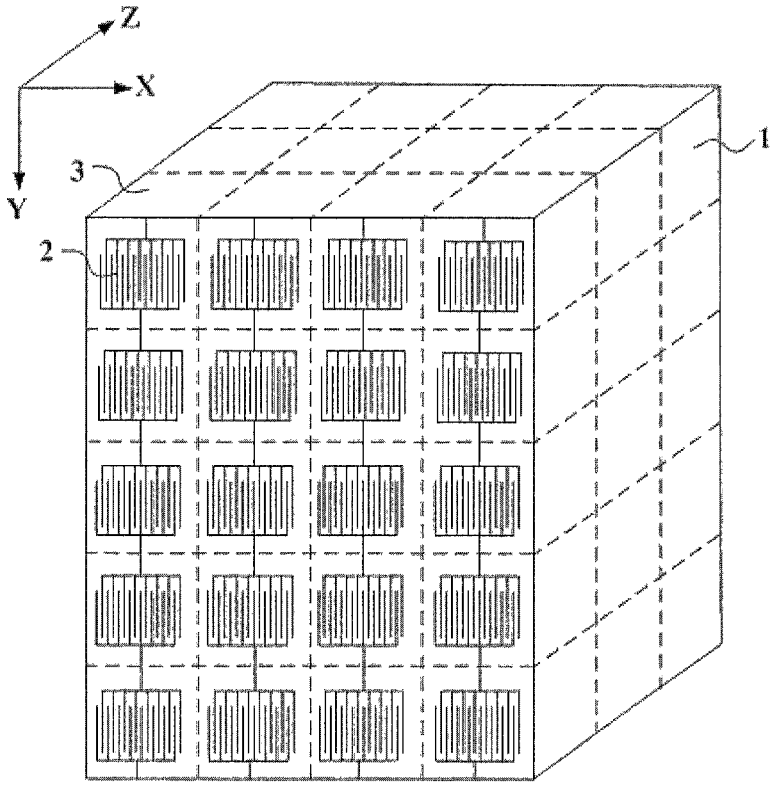
FIG. 4 is a structural schematic view of a metamaterial according to a second embodiment.
Figure 5:
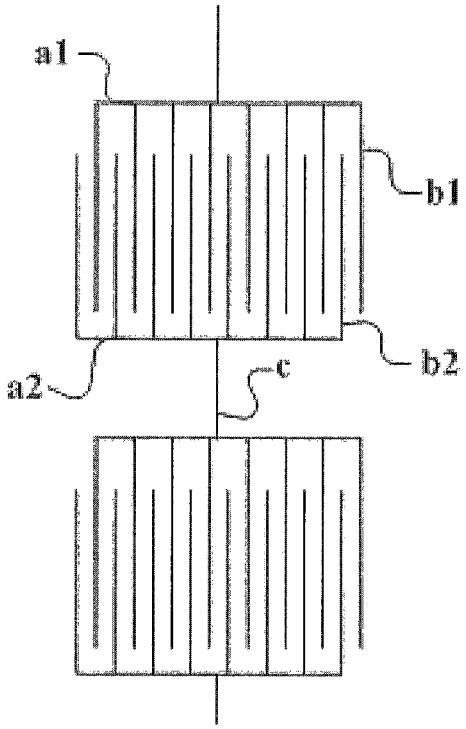
FIG. 5 is a structural schematic view of two adjacent artificial microstructures shown in the second embodiment of this disclosure.

Referring to FIGS. 4 and 5, the metamaterial includes three metamaterial layers 1, and the three metamaterial layers 1 are stacked together in turn along a direction perpendicular to the plane of the substrate (the direction of Z axis). Each metamaterial layer 1 is virtually divided into a plurality of identical cuboid metamaterial units 3, the metamaterial units 3 are close adjacent to each other and are arranged along the X-direction for the row, the Y-direction for the column orthogonal to the X-direction. Each metamaterial unit 3 includes a substrate unit and a plurality of artificial microstructures 2 attached to the substrate unit. In one embodiment, a side (e.g., a width, a length or thickness) of the metamaterial unit 3 falls within a range, the range being less than one fifth of a wavelength of the incident electromagnetic wave, preferably one tenth to one fifth. As shown in FIG. 4, the metamaterial of the present disclosure is made up of a plurality of the identical metamaterial units 3, which are arranged along X-direction, Y-direction, and Z-direction into the array arrangement.

In this embodiment, each metamaterial layer includes at least three third metal wire c connected to the first metal wire a1 and/or the second metal wire a2. Some of the third metal wires c are only connected to the first metal wire a1, some of the third metal wires c are only connected to the second metal wire a2, and some of the third metal wires c are simultaneously connected to the first metal wires a1 and the second metal wires a2 of the two adjacent artificial microstructures.

Referring to FIG. 5, in this embodiment, the two adjacent artificial microstructures are connected to each other through the third metal wire c, and each of the third metal wires c is a linear shape. Each artificial microstructure includes a first metal wire a1, a second metal wire a2 parallel to the first metal wire a1, eight first metal wire branches b1 and eight second metal wire branches b2. One end of each first metal wire branch b1 is connected to the first metal wire a1, the other end is defined as a free end facing towards the second metal wire a2. One end of any second metal wire branch b2 is connected to the second metal wire a2, and the other end as a free end faces towards the first metal wire a1. The first metal wire branches b1 and the second metal wire branches b2 are parallel to each other and are evenly interlacement distributed. The first metal wire branches b1 and the second metal wire branches b2 are perpendicular to the first metal wire a1 and the second metal wire a2.

Figure 6:
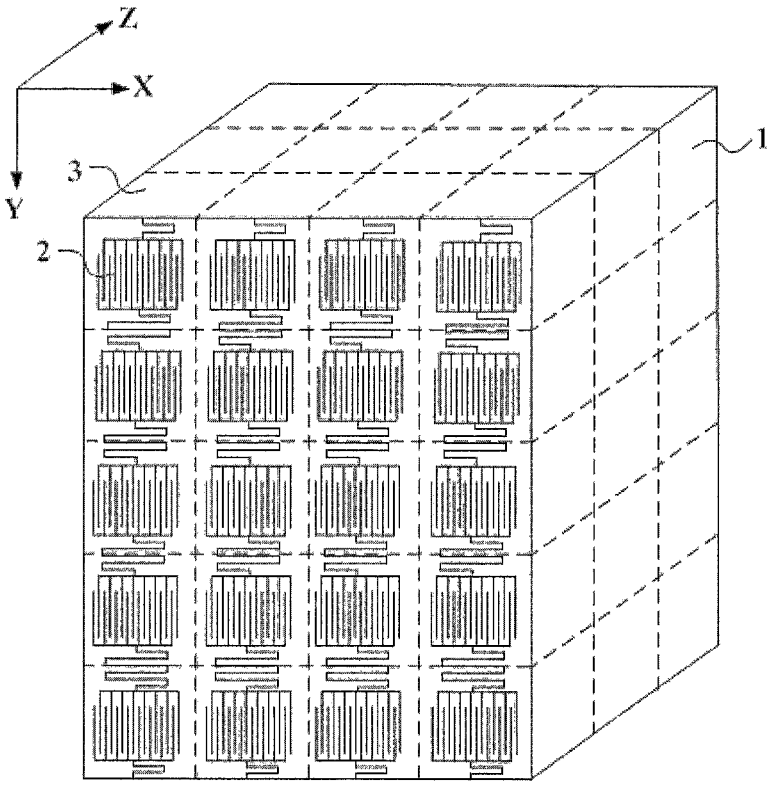
FIG. 6 is a structural schematic view of a metamaterial according to a third embodiment.
Figure 7:
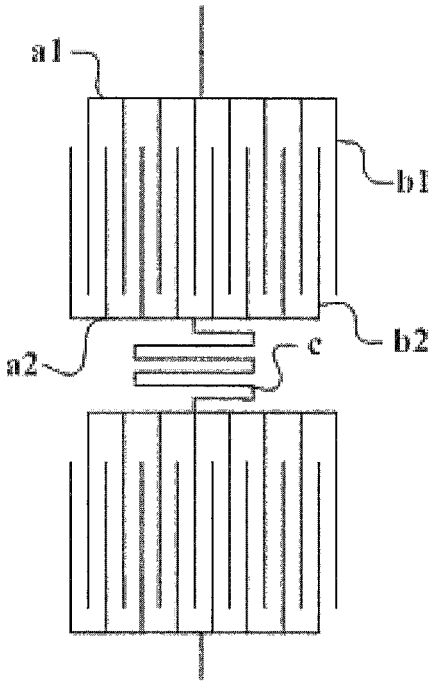
FIG. 7 is a structural schematic view of two adjacent artificial microstructures shown in the third embodiment of this disclosure.

Referring to FIGS. 6 and 7, the metamaterial includes three metamaterial layers 1, and the three metamaterial layers 1 are stacked together in turn along a direction perpendicular to the plane of the substrate (the direction of Z axis). Each metamaterial layer 1 is virtually divided into a plurality of identical cuboid metamaterial units 3, the metamaterial units 3 are close adjacent to each other and are arranged along the X-direction for the row, the Y-direction for the column orthogonal to the X-direction. Each metamaterial unit 3 includes a substrate unit and a plurality of artificial microstructures 2 attached to the substrate unit. In one embodiment, a side (e.g., a width, a length or thickness) of the metamaterial unit 3 falls within a range, the range being less than one fifth of a wavelength of the incident electromagnetic wave, preferably one tenth to one fifth. Referring to FIG. 6, the metamaterial of the present disclosure is made up of a plurality of the identical metamaterial units 3, which are arranged along the X-direction, Y-direction, and the Z-direction into an array arrangement.

As shown in FIG. 7, the two adjacent artificial microstructures are connected to each other through a third metal wire c, and the third metal wire c shows a sinuous shape. In other embodiment, the third metal wire c can be a wavy shape, polygonal shape or other curved shapes. Each artificial microstructure includes a first metal wire a1, a second metal wire a2 parallel to the first metal wire a1, eight first metal wire branches b1 and eight second metal wire branches b2. One end of each first metal wire branch b1 is connected to the first metal wire a1, the other end is defined as a free end facing towards the second metal wire a2. One end of any second metal wire branch b2 is connected to the second metal wire a2, and the other end as a free end faces towards the first metal wire a1. The first metal wire branches b1 and the second metal wire branches b2 are parallel to each other and are evenly interlacement distributed. The first metal wire branches b1 and the second metal wire branches b2 are perpendicular to the first metal wire a1 and the second metal wire a2.

Although the present disclosure has been specifically described on the basis of the exemplary embodiment thereof, the disclosure is not to be construed as being limited thereto. Various changes or modifications may be made to the embodiment without departing from the scope or spirit of the disclosure.

What is claimed is:

1. An artificial microstructure used in a metamaterial which comprises at least one artificial microstructure, comprising:

a first metal wire;

a second metal wire parallel to the first metal wire;

at least one first metal wire branch; and at least one second metal wire branch, wherein a third metal wire is connected between the first meal wire and the second metal wire of two adjacent artificial microstructures, the at least one first metal wire branch and the at least one second metal wire branch are distributed in an interlacement arrangement to increase the capacitance of the artificial microstructure and the refractive index and pertimittivity of the metamaterial, the at least one first metal branch and the at least one second metal branch are parallel to each other, one end of the at least one first metal wire branch is connected to the first metal wire and is perpendicular to the first metal wire, the other end is a free end facing towards the second metal wire; one end of the at least one second metal wire branch is connected to the second metal wire and is perpendicular to the second metal wire, and the other end of the at least one second metal wire is a free end facing towards the first metal wire.

2. The artificial microstructure of claim 1, wherein the at least one first metal branch and the at least one second metal branch are evenly distributed.

3. The artificial microstructure of claim 1, wherein the number of the first metal wire branches is equal to the number of the second metal wire branches.

4. The artificial microstructure of claim 1, wherein the number of the first metal wire branches is unequal to the number of the second metal wire branches.

5. The artificial microstructure of claim 2, wherein the at least one first metal branch and the at least one second metal branch are parallel to each other.

6. The artificial microstructure of claim 2, wherein the number of the first metal wire branches is equal to the number of the second metal wire branches.

7. The artificial microstructure of claim 2, wherein the number of the first metal wire branches is unequal to the number of the second metal wire branches.

8. A metamaterial, comprising:

at least one metamaterial layer, and each metamaterial layer comprising:

a substrate; and at least three third metal wires;

at least one artificial microstructure attached to the substrate, and each artificial microstructure comprising:

a first metal wire;

a second metal wire parallel to the first metal wire, and the three third metal wires connected to the first metal wire and/or the second metal wire;

at least one first metal wire branch; and at least one second metal wire branch, wherein the third metal wires are connected between the first metal wires and the second metal wires of the two adjacent artificial microstructures, the at least one first metal wire branch and the at least one second metal wire branch are distributed in an interlacement arrangement to increase the capacitance of the artificial microstructure and the refractive index and pertimittivity of the metamaterial, the at least one first metal branch and the at least one second metal branch are parallel to each other, one end of the at least one first metal wire branch is connected to the first metal wire and is perpendicular to the first metal wire, the other end is defined as a free end facing towards the second metal wire; one end of the at least one second metal wire branch is connected to the second metal wire and is perpendicular to the second metal wire, and the other end of the at least one second metal wire as a free end faces towards the first metal wire.

9. The metamaterial of claim 8, wherein each metamaterial layer comprises at least two artificial microstructures.

10. The metamaterial of claim 9, wherein each third metal wire is a straight line.

11. The metamaterial of claim 9, wherein each third metal wire is a curve.

12. The metamaterial of claim 9, wherein each third metal wire is a sinuous curve.

13. The metamaterial of claim 8, wherein the plurality of artificial microstructures are placed in an array arrangement on the substrate.

14. The metamaterial of claim 8, wherein the substrate is divided into multiple identical cuboid metamaterial units in the form of array arrangement, and each substrate unit is attached by an artificial microstructure.

15. The metamaterial of claim 8, wherein a side of the substrate falls within a range between one tenth to one fifth.

16. The metamaterial of claim 8, wherein the substrate is made from FR-4, F4b, CEM1 or TP-1.

17. The metamaterial of claim 16, wherein the substrate is made from any of polytetrafluoroethylene, ferroelectric material, ferrite material and ferromagnetic material.

18. The metamaterial of claim 8, wherein the metamaterial comprises a plurality of substrates stacked together, and each substrate is attached by a plurality of artificial microstructures.

19. The metamaterial of claim 18, wherein any two adjacent substrates are connected together by filling liquid substrate materials.

* * * * *